US006926501B2

(12) United States Patent
Abdelrahman

(10) Patent No.: US 6,926,501 B2
(45) Date of Patent: Aug. 9, 2005

(54) TWO-PIECE SWASHPLATE PUMP HOUSING

(75) Inventor: Ashraf B. Abdelrahman, Peoria, IL (US)

(73) Assignee: Caterpillar Inc, Peoria, IL (US)

( * ) Notice: Subject to any disclaimer, the term of this patent is extended or adjusted under 35 U.S.C. 154(b) by 51 days.

(21) Appl. No.: 10/294,916

(22) Filed: Nov. 15, 2002

(65) Prior Publication Data

US 2004/0096335 A1 May 20, 2004

(51) Int. Cl.[7] ..... F04B 1/12; F04B 1/26
(52) U.S. Cl. ..... 417/269; 417/222.1; 417/222.2
(58) Field of Search ..... 417/269, 222.1, 417/222.2; 92/71

(56) References Cited

U.S. PATENT DOCUMENTS 3,304,886 A * 2/1967 Roberts ..... 417/222.1
3,450,058 A * 6/1969 Stein ..... 92/71
3,663,122 A * 5/1972 Kitchen ..... 417/269
3,873,240 A * 3/1975 Leduc et al. ..... 417/222.1
3,981,630 A * 9/1976 Leduc et al. ..... 417/269
4,149,830 A * 4/1979 Woodruff ..... 417/222.1
6,035,828 A 3/2000 Anderson et al.
6,216,670 B1 4/2001 Anderson et al.

* cited by examiner

*Primary Examiner*—Justine R. Yu
*Assistant Examiner*—Timothy P. Solak
(74) *Attorney, Agent, or Firm*—Finnegan, Henderson, Farabow, Garrett & Dunner

(57) ABSTRACT

A housing for a hydraulic pump is provided. The pump has an input shaft connected to a swashplate, a plurality of pistons, a plurality of check valves, and a metering device having an actuator. The housing includes a first housing member having a fluid inlet, a shaft bore adapted to receive the input shaft, and a swashplate bore adapted to receive the swashplate. A second housing member has a plurality of cylinders adapted to slidably receive the plurality of pistons and a plurality of check valve bores that are in fluid communication with the cylinders and are adapted to receive the plurality of check valves. The second housing member also includes an actuator bore configured to receive at least a portion of the actuator, a collector cavity in fluid communication with each of the check valve bores, and a fluid outlet in fluid communication with the collector cavity.

17 Claims, 4 Drawing Sheets

TWO-PIECE SWASHPLATE PUMP HOUSING

TECHNICAL FIELD

The present disclosure is directed towards hydraulic pumps and, more particularly, to a housing for a hydraulic pump.

BACKGROUND

Many vehicles, such as, for example highway trucks and off-road work machines, use pressurized fluid during their standard operation. The pressurized fluid may be used for any of a number of purposes during the operation of the vehicle. A highway truck, for example, may use pressurized fluid to operate a fuel injection system or a braking system. A work machine, for example, may use pressurized fluid to propel the machine around a work site or to move a work implement.

Each of these vehicles typically includes a pump that generates a flow of pressurized fluid for use during the operation of the vehicle. Often, however, the pressurized fluid requirements of the vehicle fluctuate depending upon the operating conditions of the vehicle. To avoid wasting pressurized fluid when the vehicle requires a relatively low amount of pressurized fluid, the pumps are typically configured to adjust the amount of generated pressurized fluid based on the operating conditions of the vehicle.

One type of pump that may be controlled to generate a variable flow of pressurized fluid is known as a constant displacement variable flow pump. An exemplary constant displacement variable flow pump is described in U.S. Pat. No. 6,035,828 to Anderson et al. The described pump includes a rotatable swashplate that drives a series of pistons through a compression stroke to pressurize an operating fluid. A check valve is associated with each piston. The check valve is configured to open and allow a flow of fluid when the piston pressurizes the fluid to a predetermined pressure level. The pump also includes a metering device that may be adjusted to vary the amount of fluid that is pressurized with each piston stroke. By controlling the position of the metering device, the amount of fluid that is pressurized with each piston stroke may be controlled. Thus, by adjusting the metering device, the flow rate of pressurized fluid generated by the pump may be controlled.

As also shown in U.S. Pat. No. 6,035,828 to Anderson et al., a constant displacement variable flow pump includes a number of moving parts. This type of pump typically requires a complex housing to support each of these components. For example, a typical constant displacement variable flow pump includes a first housing member that supports the rotatable swashplate and associated input shaft. A second housing member, commonly referred to as a barrel, forms the cylinders that receive the pistons. A third housing member may house the check valves and form a pressurized fluid storage cavity. In addition, the pump may include additional housing members to house the metering device components and any additional pump components.

The manufacturing effort required to make the pump housing and the assembly effort required to assemble the pump constitutes a significant portion of the total cost of producing a constant displacement variable flow pump. This total cost may be decreased by reducing the number of housing components and/or increasing the number of functions performed by each housing component.

In addition, the overall size of the pump is determined, at least in part, by the shape and number of the housing components. A pump with a larger overall size is more difficult to position in an engine compartment of a vehicle. A reduction in the number and/or complexity of the pump housing compartments may lead to a reduction in the overall size of the pump.

The hydraulic pump housing of the present disclosure solves one or more of the problems set forth above.

SUMMARY OF THE INVENTION

According to one aspect, the present disclosure is directed to a housing for a hydraulic pump that has an input shaft connected to a swashplate, a plurality of pistons, a plurality of check valves, and a metering device having an actuator. The housing includes a first housing member having a fluid inlet, a shaft bore adapted to receive the input shaft, and a swashplate bore adapted to receive the swashplate. A second housing member has a plurality of cylinders adapted to slidably receive the plurality of pistons and a plurality of check valve bores that are in fluid communication with the cylinders and are adapted to receive the plurality of check valves. The second housing member also includes an actuator bore configured to receive at least a portion of the actuator, a collector cavity in fluid communication with each of the check valve bores, and a fluid outlet in fluid communication with the collector cavity. The second housing member is connected to the first housing member to maintain the swashplate in engagement with the plurality of pistons.

In another aspect, the present disclosure is directed to a method of assembling a hydraulic pump. An input shaft is disposed in a shaft bore of a first housing member. A swashplate is disposed in a swashplate bore in the first housing member. A plurality of pistons are disposed in a plurality of cylinders in a second housing member. A plurality of check valves are disposed in a plurality of check valve bores in the second housing member. The plurality of check valve bores are in fluid communication with the cylinders and a collector cavity. An actuator is disposed in an actuator bore in the second housing member. The first housing member is connected to the second housing member to operatively engage the swashplate with the plurality of pistons.

DETAILED DESCRIPTION

Figure 1:
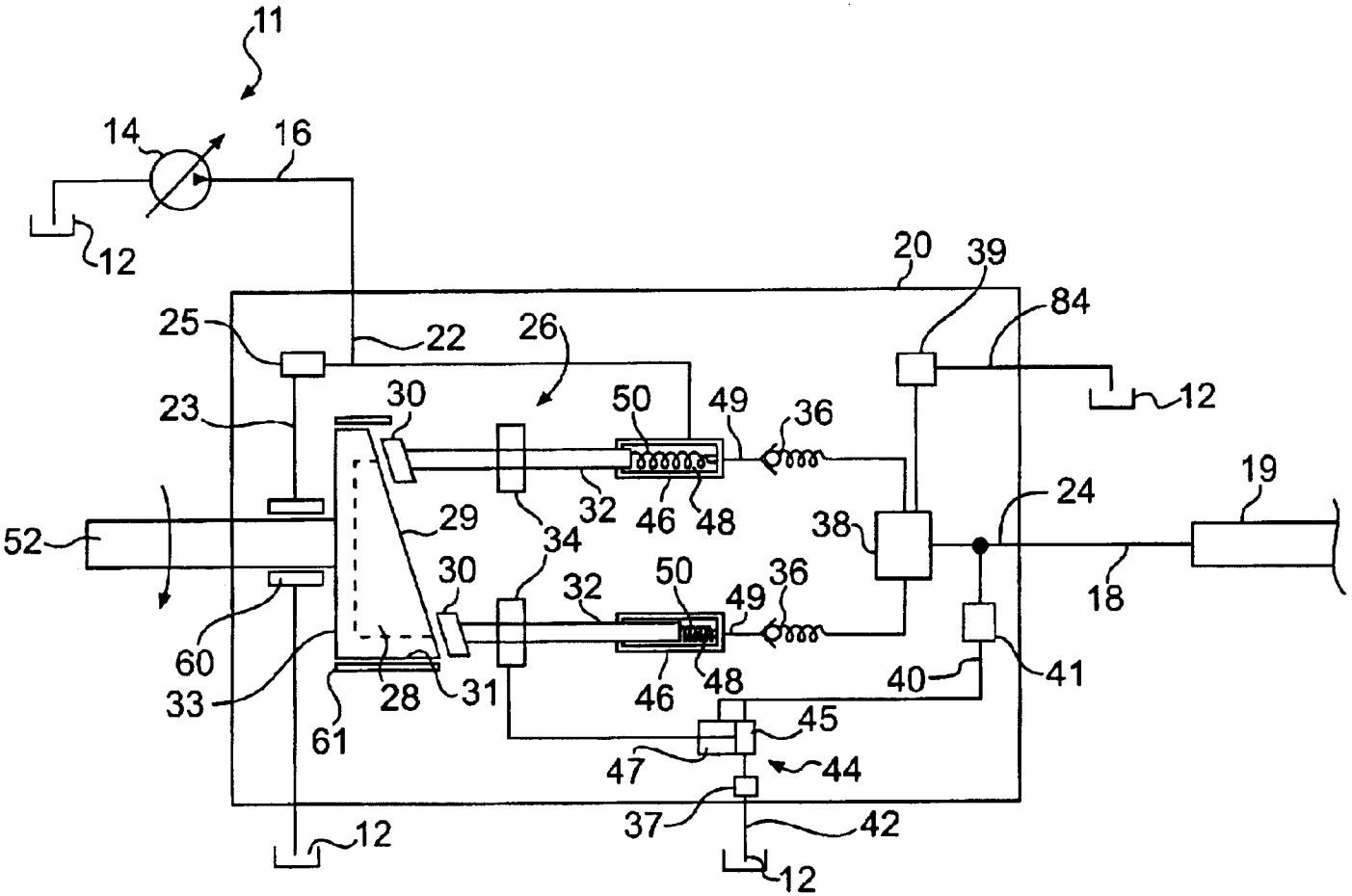
FIG. 1 is a schematic and diagrammatic representation of a hydraulic pump in accordance with an exemplary embodiment of the present invention.

An exemplary embodiment of a constant displacement variable flow pump 20 is diagrammatically and schematically illustrated in FIG. 1. As shown, pump 20 may be connected to a lubrication system 11, such as is typically included in a vehicle. Lubrication system 11 may include a tank 12 that stores a supply of an operating fluid, which may be, for example, a lubricating oil.

Lubrication system 11 may also include a supply pump 14 that draws operating fluid from tank 12 and increases the pressure of the operating fluid. Supply pump 14 may be a relatively low pressure pump, such as, for example, a sump pump as is commonly used in a vehicle lubrication system to distribute lubricating oil within an engine and/or vehicle. Supply pump 14 may increase the pressure of the fluid to a relatively low pressure, such as, for example, about 70 kPa (10.2 psi). Supply pump 14 may direct the low pressure operating fluid to pump 20 through an input line 16.

Figure 2:
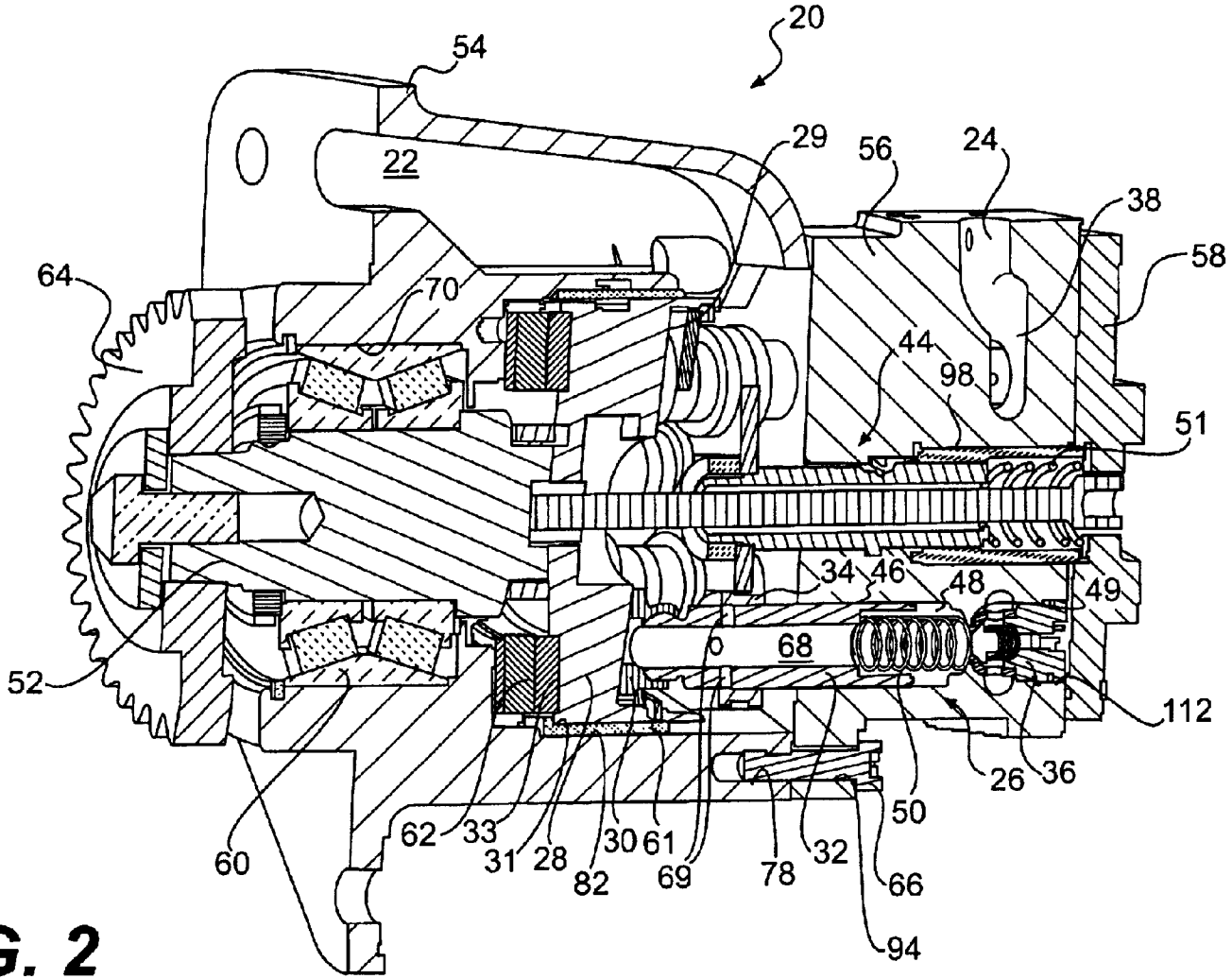
FIG. 2 is a cross sectional view of a hydraulic pump in accordance with an exemplary embodiment of the present invention.

As shown in FIG. 2, pump 20 includes a first housing member 54 and a second housing member 56. First housing member 54 defines an inlet 22. As shown in FIG. 1, inlet 22 may be connected to input line 16. Operating fluid from supply pump 14 is directed through input line 16 into inlet 22 of pump 20.

As illustrated in FIGS. 1 and 2, pump 20 may also include an input shaft 52. A gear 64 (referring to FIG. 2) may be attached to input shaft 52. Gear 64 may be operatively engaged with a crankshaft of an engine through a gear train so that a rotation of the crankshaft causes a corresponding rotation of input shaft 52. It should be noted that input shaft 52 may be connected to the engine in any manner readily apparent to one skilled in the art that will cause input shaft 52 to rotate in response to a rotation of the crankshaft of the engine.

Figure 3A:
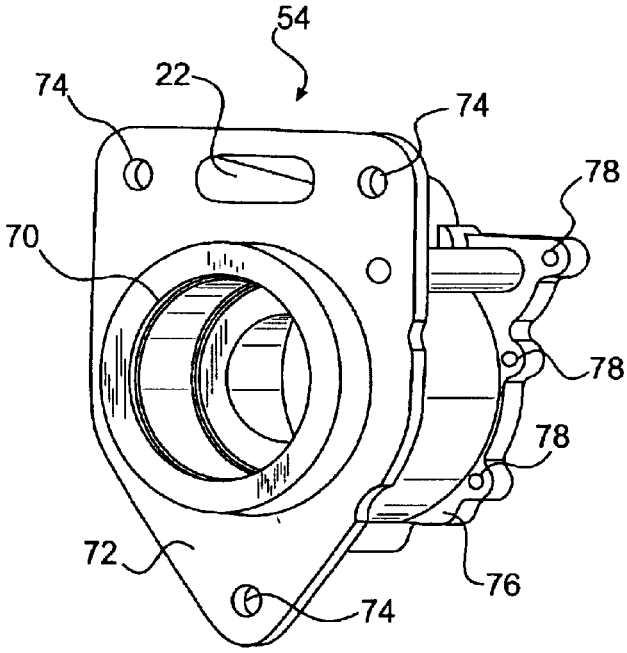
FIGS. 3*a* and 3*b* are pictorial representations of a first housing member in accordance with an exemplary embodiment of the present invention.

Referring to FIGS. 2 and 3*a*, first housing member 54 includes a shaft bore 70. Input shaft 52 may be disposed in shaft bore 70 for rotatable movement relative to first housing member 54. A bearing 60 may be disposed between input shaft 52 and shaft bore 70 to facilitate the rotation of input shaft 52. Bearing 60 may be a tapered roller bearing or any other type of bearing commonly used to support a rotating shaft, such as, for example, a journal bearing.

As schematically illustrated in FIG. 1, pump 20 may include a drain passageway 23. Drain passageway 23 may be formed in first housing member 54 to connect inlet 22 with bearing 60. It should be understood, however, that drain passageway 23 may connect inlet 22 with another bearing within pump 20 or may lead directly to tank 12.

Drain passageway 23 may be configured to bleed air from the operating fluid flowing through inlet 22. A valve 25, such as, for example, a check valve, may be disposed in drain passageway 23. Valve 25 may be configured to open when the pressure of the fluid in inlet 22 reaches a predetermined limit, such as, for example, approximately 70 kPa (10.2 psi). The opening of valve 25 may allow a mixture of air and operating fluid to flow through drain passageway 23. This removes air from the inlet flow of operating fluid and also provides lubrication for bearing 60.

As illustrated in FIGS. 1 and 2, pump 20 may also include a swashplate 28. Swashplate 28 may include an angled driving surface 29. Swashplate 28 is connected to input shaft 52 so that a rotation of input shaft 52 results in a corresponding rotation of swashplate 28.

Figure 3B:
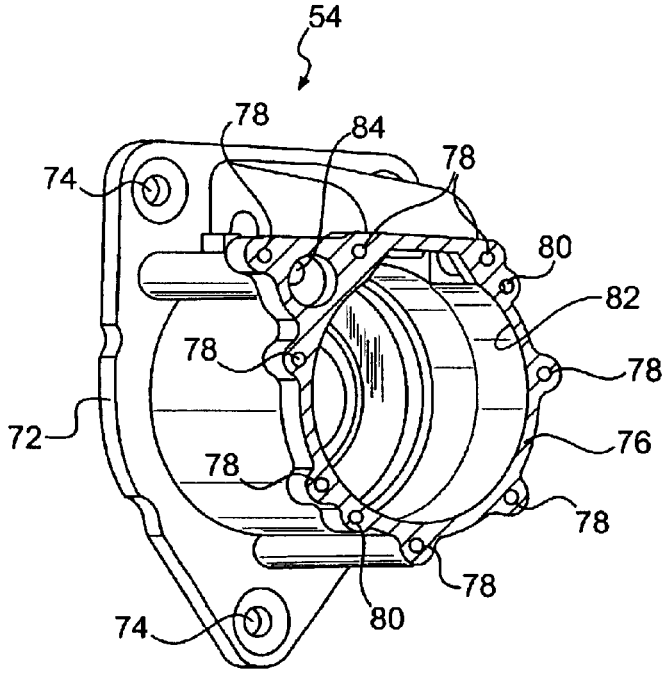

As shown in FIG. 3*b*, first housing member 54 includes a swashplate bore 82. Swashplate 28 may be disposed in swashplate bore 82 for rotating movement relative to first housing member 54. A bearing 61, such as, for example, a sleeve bearing, may be disposed between an outer surface 31 of swashplate 28 and swashplate bore 82 to facilitate a rotating movement of swashplate 28.

First housing member 54 also includes a front flange 72 and a rear flange 76. Front flange 72 includes a series of mounting holes 74 that may be used, for example, to secure pump 20 to an engine or within an engine compartment. Rear flange 76 includes a series of bolt holes 78. As described in greater detail below, bolt holes 78 may be used to secure first housing member 54 with second housing member 56.

As shown in FIGS. 1 and 2, pump 20 also includes a pumping element 26. Pumping element 26 is operable to increase the pressure of the operating fluid received through inlet 22. Pumping element 26 includes a plurality of pistons 32 that are slidably disposed in a plurality of cylinders 46 to compress the operating fluid.

Figure 4A:
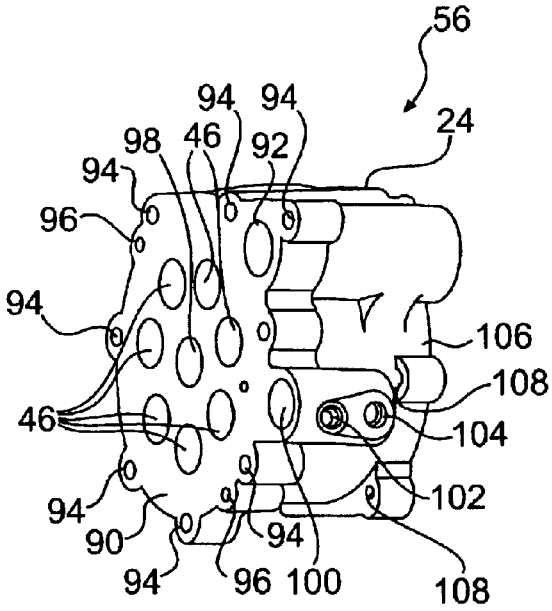
FIGS. 4*a* and 4*b* are pictorial representations of a second housing member in accordance with an exemplary embodiment of the present invention.

As shown in FIG. 4*a*, second housing member 56 defines a series of seven cylinders 46. One piston 32 may be disposed in each cylinders 46. As shown in FIG. 2, each piston 32 includes a spill port 69 and a central passageway 68. Referring to FIGS. 1 and 2, each cylinder 46 includes a compression chamber 48 and a discharge port 49. Passageway 68 in piston 32 provides a fluid conduit between compression chamber 48 and spill port 69.

As shown in FIG. 4*a*, second housing member 56 includes a front face 90 and a plurality of bolt holes 94. Bolt holes 94 in second housing member 56 are configured to align with bolt holes 78 in rear flange 76 of first housing member 54 (referring to FIGS. 3*a* and 3*b*). A series of bolts 66 (one of which is illustrated in FIG. 2) may be disposed through bolt holes 94 in second housing member 56 and through bolt holes 78 in first housing member 54 to secure second housing member 56 to first housing member 54.

Rear flange 76 of first housing member 54 may also include a pair of dowel holes 80 (referring to FIG. 3*b*). Similarly, front face 90 of second housing member 56 may also include a pair of dowel holes 96 (referring to FIG. 4*a*) that are configured to align with dowel holes 80 in rear flange 76 of first housing member 54. A pair of dowels (not shown) may be engaged with the pair of aligning dowel holes 80 and 96. Engaging the pair of dowels with dowel holes 80 and 96 will ensure that first and second housing members 54 and 56 are properly aligned when first and second housing members 54 and 56 are secured together.

Securing first housing member 54 with second housing member 56 operatively engages angled driving surface 29 of swashplate 28 with each piston 32. When first and second housing members 54 and 56 are engaged, a rotation of swashplate 28 and angled driving surface 29 sequentially drives each piston 32 through a compression stroke. In the compression stroke, each piston 32 is moved from a first position to a second position to increase the pressure of operating fluid contained in compression chamber 48. The pressurized operating fluid may exit compression chamber 48 through discharge port 49.

As shown in FIG. 2, a device, such as, for example, a pivoting shoe 30, may be disposed between each piston 32 and driving surface 29. Pivoting shoe 30 is configured to pivot relative to piston 32. The pivoting motion ensures that the respective piston 32 will remain operatively engaged with driving surface 29 as swashplate 28 rotates.

In addition, a thrust bearing 62 may be disposed between a front face 33 of swashplate 28 and swashplate bore 82 in first housing member 54. Thrust bearing 62 facilitates rotation of swashplate 28 relative to first housing member 54. One skilled in the art will recognize that rotation of swashplate 28 may be facilitated in another manner.

As shown in FIGS. 1 and 2, a series of springs 50 (one of which is illustrated in FIG. 2) may be disposed in each cylinder 46 to act on each piston 32. Spring 50 may act on piston 32 to maintain the engagement of piston 32 with driving surface 29 of swashplate 28. After angled driving surface 29 of swashplate 28 moves piston 32 to the second position, spring 50 will act on piston 32 to move piston 32 towards the first position.

Figure 4B:
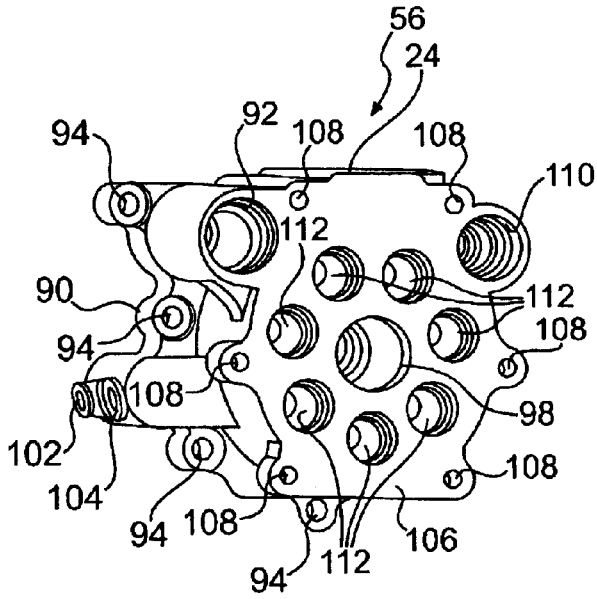

As shown in FIG. 4*b*, second housing member 56 includes a plurality of check valve bores 112 that are formed in a rear face 106 of second housing member 56. One check valve bore 112 is in fluid communication with discharge port 49 of each cylinder 46. Referring to FIG. 2, one check valve 36 may be disposed in each check valve bore 112. Each check valve 36 may be configured to open when the fluid within compression chamber 48 reaches a predetermined level. When the operating fluid reaches the predetermined pressure, check valve 36 will open to allow the pressurized fluid to flow from compression chamber 48.

As shown in FIG. 2, pump 20 also includes a cover plate 58 that may be secured to rear face 106 of second housing member 56. Rear face 106 may include a series of bolt holes 108 and cover plate 58 may include a corresponding series of bolt holes (not shown). A series of bolts may secure cover plate 58 to rear face 106 of second housing member 56. The engagement of cover plate 58 and second housing member 56 covers check valve bores 112 and holds check valve 36 in place.

Second housing member 56 may also include a collector cavity 38. Collector cavity 38 is in fluid communication with each check valve bore 112. Operating fluid that has been released through each check valve 36 flows into collector cavity 38.

Second housing member 56 also includes an outlet 24. Outlet 24 is in fluid connection with collector cavity 38. Pressurized fluid that has collected in collector cavity 38 may exit pump 20 through outlet 24.

As shown in FIG. 1, outlet 24 may be connected to an outlet line 18. Outlet line 18 may be connected with a fluid rail 19 to supply pressurized fluid to a system associated with the engine and/or vehicle. For example, fluid rail 19 may provide pressurized fluid to a fuel injection or braking system. It should be understood, however, that pump 20 may provide pressurized fluid to meet any pressurized fluid requirements on the vehicle.

As schematically illustrated in FIG. 1, a pressure relief valve 39 may be disposed in fluid connection with collector cavity 38. Pressure relief valve 39 may be configured to open to relieve an excessive pressure situation in collector cavity 38, pump outlet 24, outlet line 18, or fluid rail 19. When pressure relief valve 39 is exposed to fluid having an excessive pressure, pressure relief valve 39 may open to allow fluid to flow from collector cavity through a drain passageway 84 to tank 12.

As shown in FIG. 4*b*, second housing member 56 includes a pressure relief bore 92 that opens to rear face 106 and is in fluid connection with collector cavity 38. Pressure relief valve 39 may be disposed in pressure relief bore 92. Engagement of cover plate 58 with second housing member 56 may ensure pressure relief valve 39 is properly positioned in pressure relief bore 92.

As illustrated in FIG. 3*b*, first housing member 54 may define drain passageway 84. Drain passageway 84 is configured to align with pressure relief bore 92 when first and second housing members 54 and 56 are secured together. Thus, fluid released through pressure relief valve 39 may flow through drain passageway 84 in first housing member 54. The released fluid may then be directed to tank 12 or any other suitable location.

Pump 20 may also include a metering device that is operable to vary the rate at which pump 20 generates pressurized fluid. As shown in FIG. 2, the metering device may include a plurality of metering sleeves 34. One metering sleeve 34 is associated with each piston 32 and is configured to selectively block spill port 69 in the respective piston 32.

When spill port 69 is uncovered, operating fluid may flow from compression chamber 48 through passageway 68 and spill port 69. Movement of piston 32 towards the second position will force fluid from compression chamber 48 through spill port 69. Thus, piston 32 will not pressurize the operating fluid in compression chamber 48.

When metering sleeve 34 covers spill port 69, metering sleeve 34 prevents operating fluid from escaping compression chamber 48 through passageway 68 and spill port 69. Thus, when swashplate 28 moves piston 32 towards the second position, piston 32 will act to pressurize the operating fluid in compression chamber 48. When the fluid reaches the predetermined level, the associated check valve 36 will open to allow the pressurized fluid to flow to collector cavity 38.

Each metering sleeve 34 may be moved between a first position and a second position to control the amount of operating fluid that is pressurized during each compression stroke of each piston 32. The position of metering sleeve 34 relative to piston 32 determines the portion of the compression stroke of piston 32 in which metering sleeve 34 covers spill port 69 in piston 32. In the first position, metering sleeve 34 covers spill port 69 for the entire compression stroke of piston 32 to maximize the amount of fluid pressurized during the compression stroke. In the second position, metering sleeve 34 leaves spill port 69 uncovered for the entire compression stroke 80 of piston 32 to minimize the amount of fluid pressurized during the compression stroke. Metering sleeve 34 may be positioned at the first position, at the second position, or in between the first and second positions to achieve a desired flow rate of pressurized fluid.

The metering device may include an actuator 44 to control the position of each metering sleeve 34. As shown in FIGS. 2, 4*a*, and 4*b*, second housing member 56 includes an actuator bore 98. Actuator 44 may be disposed in actuator bore 98 so that actuator 44 extends into swashplate bore 82 of first housing member 54 to operatively engage metering sleeves 34. Engagement of cover plate 58 with second housing member 56 may ensure actuator 44 is properly positioned in actuator bore 98.

As schematically illustrated in FIG. 1, actuator 44 includes a first chamber 45 and a second chamber 47. Both first chamber 45 and second chamber 47 are in fluid communication with pump outlet 24 through a control line 40. Pressurized fluid may flow from outlet 24 to both first and second chambers 45 and 47. Alternatively, control line 40 may connect both first and second chambers 45 and 47 with collector cavity 38.

A pressure reducing valve 41 may be disposed in control line 40 to reduce the pressure of the fluid flowing to actuator 44. As shown in FIG. 4*b*, second housing member 56 includes a pressure reducing bore 110. Pressure reducing valve 41 may be disposed in pressure reducing bore 110. Engagement of cover plate 58 with second housing member 56 may ensure pressure reducing valve 41 is properly positioned in pressure reducing bore 110.

A control valve 37 may be positioned in a fluid line 42 that is connected with first chamber 45. Control valve 37 may be opened to allow fluid to flow from first chamber 45. When control valve 37 is opened, the pressure of the fluid in first chamber 45 will decrease, thereby creating a pressure differential over actuator 44. The greater pressure of the fluid in second chamber 47 will act to move actuator 44, and connected metering sleeves 34, towards the second position. By controlling the pressure of the fluid in first chamber 45, the position of actuator 44 and metering sleeve 34 may be controlled.

As illustrated in FIG. 2, actuator 44 may include a spring 51. Spring 51 may act on actuator 44 to move actuator to the first position when the pressures of the fluid within first and second chambers 45 and 47 are substantially equal. Thus, when control valve 37 is closed, the fluid pressures within first and second chambers 45 and 47 will equalize and spring 51 will move actuator 44 and metering sleeves 34 towards the first position to increase the portion of the compression stroke that spill port 69 is covered.

As illustrated in FIGS. 4*a* and 4*b*, second housing member 56 includes a control bore 100. Control bore 100 is in fluid communication with first chamber 45 in actuator bore 98 through fluid passageway 104. Fluid passageway 104 may be a drilled passageway. The outer opening in second housing member 56 formed by the drilling of fluid passageway 104 may be fitted with a plug, or other sealing device, to prevent fluid from leaking from second housing member 56.

Second housing member 56 also includes a valve opening 102. A solenoid operated valve element (not shown) may be disposed in valve opening 102. When a current is applied to the solenoid operated valve element, the valve element may open a passageway in control bore 100 to allow fluid to flow through control bore 100 to thereby decrease the pressure of fluid within first chamber 45. By controlling the position of the solenoid operated valve element, the pressure of the fluid in first chamber 45 and the movement of actuator 44 may be controlled.

Industrial Applicability

The first and second housing members 54 and 56 provide a simplified housing structure for a fixed displacement variable flow pump. Each of the first and second housing members 54 and 56 are configured to perform distinct functions required of the pump housing structure. For example, first housing member 54 performs the function of supporting the rotating input shaft 52 and swashplate 28, whereas second housing member 56 performs the function of containing and directing the pressurized fluid.

Splitting the functions performed by each of the first and second housing members 54 and 56 in this manner can reduce the effort and cost associated with the manufacturing a fixed displacement variable flow pump. For example, different materials and different heat treatments may be used in the formation of the first and second housing members 54 and 56. The material selected for the first housing member 54 should be capable of supporting the rotating components and withstanding any heat that may be generated during pump operation. The material selected for the second housing member 56 should be capable of containing the pressurized fluid.

The simplified housing structure provided by first and second housing members 54 and 56 may simplify the assembly of pump 20. As described previously, first and second housing member 54 and 56 are configured to receive each of the pump components without requiring additional housing or support members. One skilled in the art will recognize that the assembly steps for the pump may be performed in any order to facilitate the efficient assembly of the pump 20.

The simplified housing structure provided by first and second housing members 54 and 56 also minimizes the overall part count for the pump 20. The reduced part count may further reduce the assembly effort and thereby decrease the total cost of producing a constant displacement variable flow pump. In addition, the simplified housing structure may reduce the overall size of the pump 20, thereby reducing the amount of space required to position the pump 20 in an engine compartment of a vehicle.

As will be apparent to those skilled in the art, a fixed displacement variable flow pump in accordance with the present disclosure may be used to generate pressurized fluid in any of a number of applications that require pressurized fluid. For example, such a fixed displacement variable flow pump may be used to provide pressurize fluid for use in the operation of an engine. A vehicle, such as a highway truck, may use pressurized fluid to operate a a fuel injection system associated with an internal combustion engine. It is expected that many other suitable applications, such as, for example, in other systems in highway trucks or work machines, will be readily apparent to those skilled in the art.

It will also be apparent to those skilled in the art that various modifications and variations can be made in the described pump housing without departing from the scope of the invention. Other embodiments may be apparent to those skilled in the art from consideration of the specification and practice of the pumping element disclosed herein. It is intended that the specification and examples be considered as exemplary only, with a true scope of the present disclosure being indicated by the following claims and their equivalents.

What is claimed is:

1. A housing for a hydraulic pump having an input shaft connected to a swashplate, a plurality of pistons, a plurality of check valves, and a metering device having an actuator, comprising:

a first housing member having a fluid inlet, a shaft bore adapted to receive the input shaft, and a swashplate bore adapted to receive the swashplate;

a second housing member having a plurality of cylinders adapted to slidably receive the plurality of pistons, a plurality of check valve bores in fluid communication with the cylinders and adapted to receive the plurality of check valves, an actuator bore configured to receive at least a portion of the actuator, a collector cavity in fluid communication with each of the check valve bores, and a fluid outlet in fluid communication with the collector cavity, the second housing member being connected to the first housing member to maintain the swashplate in engagement with the plurality of pistons; and a cover plate engageable with the second housing member and adapted to cover the check valve bores and to retain the actuator.

2. The housing of claim 1, wherein the second housing member includes a pressure relief bore in fluid communication with the collector cavity and configured to receive a pressure relief valve.

3. The housing of claim 2, wherein the first housing member include a pressure relief passageway adapted to align with the pressure relief bore of the second housing member when the first housing member is engaged with the second housing member.

4. The housing of claim 1, wherein the second housing member includes a pressure reducing bore in fluid communication with the collector cavity and the actuator bore and configured to receive a pressure reducing valve.

5. The housing of claim 1, wherein the second housing member includes a control bore in fluid communication with the actuator bore and adapted to receive a control valve.

6. The housing of claim 1, wherein the first housing member includes a first flange having a first series of bolt holes and the second housing member includes a second flange having a second series of bolt holes configured to align with the first series of bolt holes.

7. The housing of claim 6, further including a series of bolts adapted to engage the first and second series of bolt holes to secure the first and second housing members.

8. A method of assembling a hydraulic pump, comprising:

disposing an input shaft in a shaft bore of a first housing member;

disposing a swashplate in a swashplate bore in the first housing member;

disposing a plurality of pistons in a plurality of cylinders in a second housing member;

disposing a plurality of check valves in a plurality of check valve bores in the second housing member, the plurality of check valve bores being in fluid communication with the cylinders and a collector cavity;

disposing an actuator in an actuator bore in the second housing member;

connecting the first housing member to the second housing member to operatively engage the swashplate with the plurality of pistons; and engaging a cover plate with the second housing member to cover the check valve bores and to retain the actuator in the actuator bore.

9. The method of claim 8, further including:

disposing a pressure relief valve in a pressure relief bore in the second housing member;

disposing a pressure reducing valve in a pressure reducing bore in the second housing member; and disposing a control valve in a control bore in the second housing member.

10. A hydraulic pump, comprising:

a swashplate having a driving surface;

an input shaft connected to the swashplate;

a plurality of pistons engageable with the driving surface of the swashplate and adapted to increase the pressure of an operating fluid;

a plurality of check valves adapted to allow a flow of pressurized fluid when the fluid reaches a predetermined pressure;

a metering device having an actuator and adapted to vary a flow rate of the flow of pressurized fluid;

a first housing member having a fluid inlet, a shaft bore adapted to receive the input shaft, and a swashplate bore adapted to receive the swashplate;

a second housing member having a plurality of cylinders adapted to slidably receive the plurality of pistons, a plurality of check valve bores in fluid communication with the cylinders and adapted to receive the plurality of check valves, an actuator bore configured to receive the actuator, a collector cavity in fluid communication with each of the check valve bores, and a fluid outlet in fluid communication with the collector cavity, the second housing member engageable with the first housing member to operatively engage the swashplate with the plurality of pistons; and a cover plate engageable with the second housing member and adapted to cover the check valve bores and to retain the actuator.

11. The pump of claim 10, further including a pressure relief valve and wherein the second housing member includes a pressure relief bore in fluid communication with the collector cavity and adapted to receive the pressure relief valve.

12. The pump of claim 11, wherein the first housing member include a pressure relief passageway adapted to align with the pressure relief bore of the first housing member when the first housing member is engaged with the second housing member.

13. The pump of claim 10, further including a pressure reducing valve and wherein the second housing member includes a pressure reducing bore in fluid communication with the collector cavity and the actuator bore and configured to receive the pressure reducing valve.

14. The pump of claim 13, further including a control valve and wherein the second housing member includes a control bore in fluid communication with the actuator bore and adapted to receive the control valve.

15. The pump of claim 10, wherein the actuator defines a first chamber and a second chamber within the actuator bore and the control valve is operable to control the pressure of fluid within one of the first and second chambers.

16. The pump of claim 10, further including a thrust bearing disposed in the swashplate bore of the first housing.

17. The pump of claim 10, further including a roller bearing disposed in the shaft bore of the first housing member and configured to support the input shaft.

* * * * *